US008695477B2

(12) United States Patent
Esch

(10) Patent No.: US 8,695,477 B2
(45) Date of Patent: Apr. 15, 2014

(54) BOLT CATCH-RELEASE LEVER

(75) Inventor: Brian Esch, Maple Valley, WA (US)

(73) Assignee: Tactical Link, Inc., Salina, KS (US)

( * ) Notice: Subject to any disclaimer, the term of this patent is extended or adjusted under 35 U.S.C. 154(b) by 273 days.

(21) Appl. No.: 13/114,588

(22) Filed: May 24, 2011

(65) Prior Publication Data

US 2011/0283580 A1 Nov. 24, 2011

Related U.S. Application Data

(60) Provisional application No. 61/347,673, filed on May 24, 2010.

(51) Int. Cl.
*F41A 17/42* (2006.01)

(52) U.S. Cl.
USPC ..... 89/138; 42/14; 42/69.02

(58) Field of Classification Search
USPC ..... 89/138, 143; 42/106, 69.02, 14, 16
See application file for complete search history.

(56) References Cited

U.S. PATENT DOCUMENTS

| | | | | |
|---|---|---|---|---|
| 6,722,253 | B2 * | 4/2004 | Johnson | 89/1.42 |
| 6,763,755 | B2 * | 7/2004 | Johnson | 89/1.42 |
| 6,901,837 | B2 * | 6/2005 | Johnson | 89/1.4 |
| 7,395,747 | B2 * | 7/2008 | Murello | 89/137 |
| 8,161,861 | B2 * | 4/2012 | Haley et al. | 89/1.4 |
| 2003/0208940 | A1 * | 11/2003 | Johnson | 42/18 |
| 2003/0208941 | A1 * | 11/2003 | Johnson | 42/18 |
| 2004/0255766 | A1 * | 12/2004 | Johnson | 89/1.42 |
| 2006/0265925 | A1 * | 11/2006 | Murello | 42/70.01 |
| 2008/0078284 | A1 * | 4/2008 | Murello | 89/137 |
| 2010/0251591 | A1 * | 10/2010 | Burt et al. | 42/70.01 |

OTHER PUBLICATIONS

"AR-15 Extended Bolt Release I & II—Police Store", Brownells, Inc., Copyright 2012. Retrieved Jul. 11, 2012. URL=http://www.policestore.com/ .aspx/sid=25786/pid=9900/Product/Bolt_Release_I?source=pjm&mc_id=p115000&gdftrk=gdfV21820_a_7c323_a_7c1475_a_7c722015001_d_722015001_d_4897&subid=1500, 1 Page.

"AR-15/M16/AR-Style .308 Extended Bolt Release—Brownells", Brownells, Inc., Copyright 2012. Retrieved Jul. 11, 1012. URL=http://www.brownells.com/.aspx/sid=61176/pid=31943/Product/EBRv1_Extended_Bolt_Release?utm_medium=shoppingengine&utm_source=googlebase&mc_id=10000&gdftrk=gdfV21820_a_7c187_a_7c745_a_7c100004898_d_100004898_d_10947, 1 Page.

"Magpul B.A.D.—extended bolt release", discussion forum thread originating Apr. 28, 2009, Retrieved Jul. 11, 2012. URL= http://www.weaponevolution.com/forum/showthread.php?1159-Magpul-B.A.D.-extended-bolt-release, 7 Pages.

(Continued)

*Primary Examiner* — Benjamin P Lee
(74) *Attorney, Agent, or Firm* — Seed IP Law Group PLLC

(57) ABSTRACT

An assembly for a bolt catch on a firearm having a bolt that slides between a latched position and an unlatched position, the bolt held in the latched position by a bolt catch mechanism that includes a catch-release actuator pivotally mounted on the rifle to provide for latching and unlatching of the bolt by a user, the assembly including a lever having an L-shaped body that comprises a first leg and a second leg that is formed at substantially a right angle to the first leg, the first leg having a free end on which is formed a mounting member; and a clamp member structured to attach to the mounting member on the lever to enable clamping of the lever to the catch-release actuator in a manner that does not require disassembly of the firearm or disassembly or removal of the catch-release actuator from the firearm.

10 Claims, 20 Drawing Sheets

(56) References Cited

OTHER PUBLICATIONS

MidwayUSA, Inc., Copyright 2012. Retrieved Jul. 11, 2012. URL—http://media.midwayusa.com/productimages/large/918/918614.jpg, 1 Page.

"Extended Bolt Release V1 (EBRV1)", Phase 5 Tactical, accessed Jul. 20, 2012, URL=http://www.phase5tactical.com/products/308-dpms-type/ebrv1- , 1 Page.

"Extended Bolt Release V2/308 (EBRV2/308)", Phase 5 Tactical, accessed Jul. 20, 2012, URL= http://www.phase5tactical.com/products/308-dpms-type/extended-bolt-release-v2308-ebrv2308, 1 Page.

"Troy Ambidextrous Bolt Release", Troy Industries, accessed Jul. 20, 2012, URL=http://store.troyind.com/Enhanced_Trigger _Guard_p/sbol-amb-00bt-00.htm, 1 Page.

"B.A.D. Lever—Battery Assist Device—AR15/M16", Magpul Industries Corp, accessed Jul. 20, 2012, URL=http://store.magpul.com/product/MAG980/100, 1 Page.

Brownell's Catalog No. 61 for 2008-2009, Jan. 1, 2008, received Feb. 13, 2012, 3 Pages.

* cited by examiner

BOLT CATCH-RELEASE LEVER

BACKGROUND

1. Technical Field

The present disclosure pertains to battery carrier group release mechanisms in firearms and, more particularly, to an assembly that facilitates rapid releasing of a bolt catch.

2. Description of the Related Art

Firearms, and in particular, rifles, utilize portable ammunition cartridges or magazines that contain a limited number of bullets or rounds. Ammunition magazines are releasably attached to the rifle in order to provide a supply of ammunition.

In certain situations, such as in combat, it is desirable for the magazines to be firmly mounted to the rifle when in use and then quickly and easily released from the rifle for rapid replacement. Many firearms have a mechanism the user can manipulate to release the magazine from its positive engagement with the rifle. Typically, the rifle bolt must be held in a back or open position in order to exchange magazines. After a new magazine has been attached to the rifle, the bolt must be released to slide forward, usually loading a new round in the chamber as it does so.

A bolt catch-release mechanism is generally provided that catches the bolt in its rearward position and, when manipulated by the user, releases the bolt after the magazine has been replaced. In some situations, such as removing a jam, or inspection, rapid redeployment of the weapon is not an issue and the user is not concerned with moving quickly. However, in training or combat, minimizing downtime can be mission critical.

More particularly, this multi-step process requires the user to stop firing, move the rifle out of firing position, and to focus on the bolt, the bolt catch-release mechanism, and the magazines to effectuate a successful reload. In some cases, the user must switch hands when holding the rifle in order to manipulate the bolt carrier, the catch-release mechanism, and the magazines. Not only is this time-consuming and somewhat clumsy, it also reduces the effectiveness of the user in maintaining fire control in a combat situation.

Most rifle designs have the bolt catch-release mechanism on the left side of the weapon, which is understood to be the shooter's left side when the weapon is in firing position against the user's shoulder, regardless of whether it is the left or the right shoulder. One proposed device to assist users in more easily releasing the bolt catch without having to reach over the top of the receiver is a lever that attaches to the bolt catch mechanism using a longer bolt catch roll pin as a pivot axle. The lever extends down the left side of the weapon and then through the trigger well, typically near the front of the trigger guard where it can be reached with the trigger finger by extending the trigger finger through the trigger well. Installation of this device requires driving out the existing bolt catch roll pin and driving a new roll pin with the lever attached in place. While this design does not require a gunsmith, it does require partial disassembly of the weapon.

Another proposed design utilizes a paddle extension that attaches to the catch-release mechanism and extends down the left side of the weapon and through the trigger well to project to the right side of the trigger well ahead of the trigger. This enables right-handed shooters to manipulate the paddle using the extension device with their trigger finger. This design has a two-piece structure that clamps to the catch-release mechanism with a single screw. A disadvantage with this design is that it can work itself loose and not stay rigidly attached to the catch-release paddle.

BRIEF SUMMARY

In accordance with the present disclosure, an assembly is provided for a bolt catch on a firearm in which the bolt slides between a latched position and an unlatched position. The bolt is held in the latched position by a bolt catch mechanism that includes a catch-release actuator pivotally mounted on the rifle to provide for latching and unlatching of the bolt by a user. The assembly includes a lever having an L-shaped body that includes a first leg and a second leg that is formed at substantially a right angle to the first leg, the first leg having a free end on which is formed a mounting member, such as a clamp head; and a clamp member structured to attach to the mounting member on the lever, the clamp member and mounting member cooperating to enable clamping of the lever to the catch-release actuator in slidable engagement therewith in a manner that does not require disassembly of the firearm or disassembly or removal of the catch-release actuator from the firearm. The second leg of the lever has a free end and includes an indentation in a surface of the free end sized and shaped to receive a user's trigger finger.

In accordance with another aspect of the present disclosure, a mechanism for use with a rifle is provided, the mechanism including a lever assembly having a first extension leg and a second extension leg projecting at an angle to the first extension leg, the first extension leg having a first clamp member formed on one end, the second extension leg having a finger engaging groove formed on a surface and adjacent a free end thereof, the lever assembly further including a second clamp member structured to be attached to the first clamp member to form a two-part clamp. In addition, a ledge is formed on one of the first and second clamp members that cooperates with a second ledge on the other of the first and second clamp members to form a receptacle. The mechanism further includes a set screw threadably engaged with one of the first and second clamp members to project into the receptacle formed by the first and second clamp members.

In accordance with another aspect of the present disclosure, the first clamp member has a stepped wall forming a longitudinally oriented shoulder, and the back wall has a length that is shorter than a length of the front wall so that when the second clamp member is attached to the first clamp member, an opening is left between a free edge of the back wall and the ledge of the first clamp member that opens into the receptacle.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or components or both associated with firearms, including but not limited to rifles and pistols have not been shown or described in order to avoid unnecessarily obscuring descriptions of the embodiments.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one embodiment" or "an embodiment" means that a particular feature, structure, or characteristic described in connection with the embodiment is included in at least one embodiment. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

Figure 1:
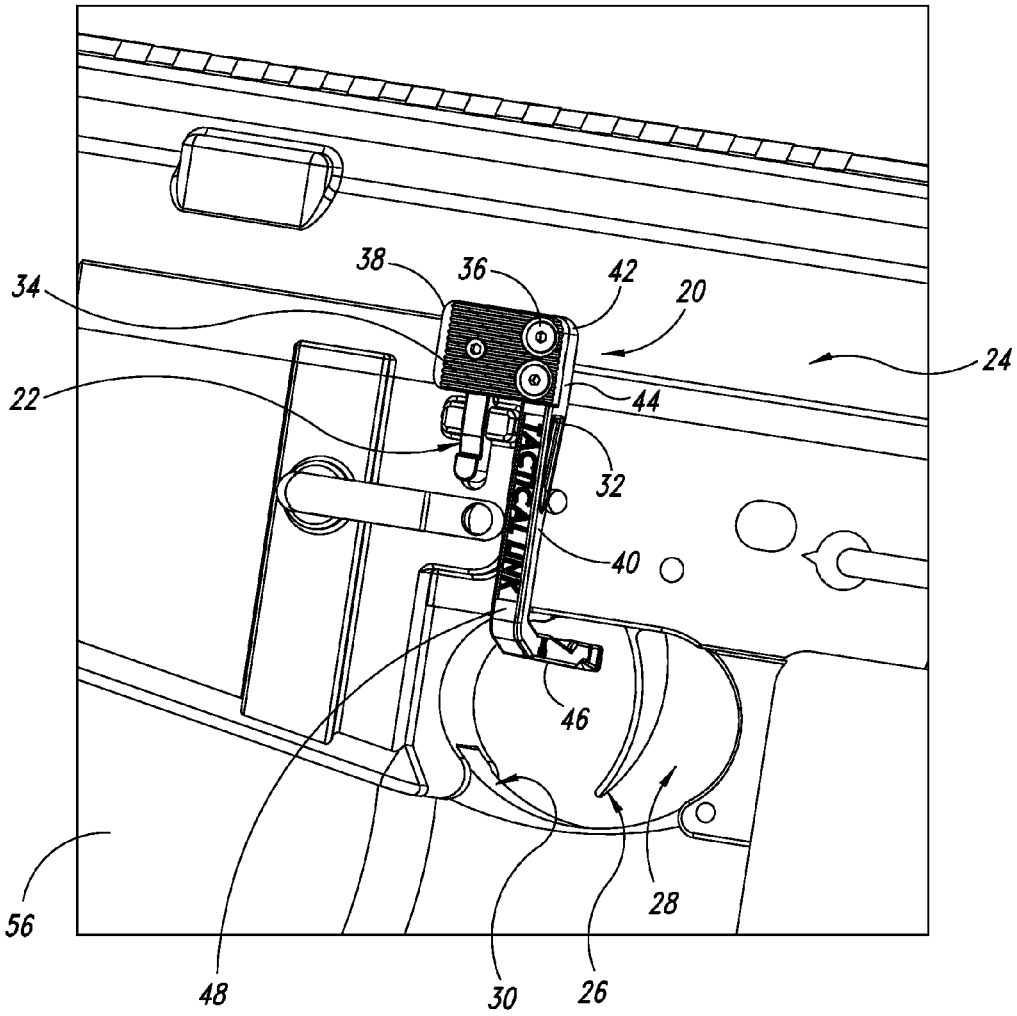
FIG. 1 is an isometric view of a left side of a conventional firearm showing a bolt carrier group catch-release actuator mechanism used with a bolt carrier group catch-release lever formed in accordance with present invention.
Figure 2:
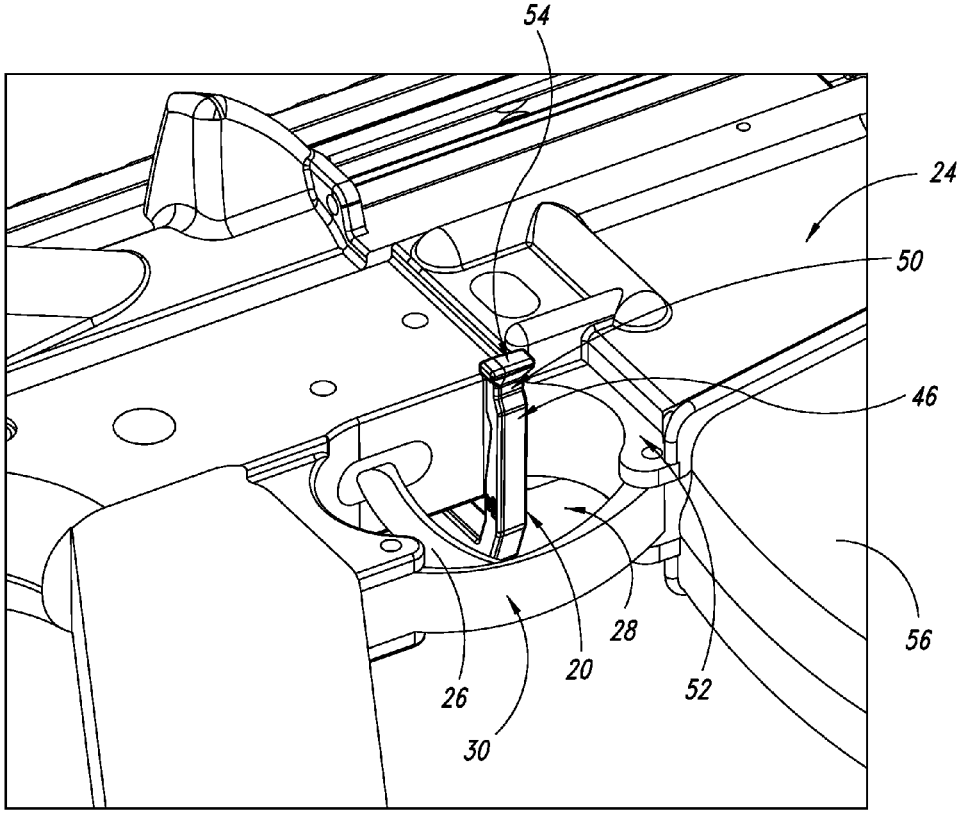
FIG. 2 is a bottom right side isometric view of the firearm of FIG. 2 showing the catch-release assist lever extending through the trigger guard.

Referring initially to FIGS. 1 and 2, shown therein is a catch-release lever assembly 20 formed in accordance with the present disclosure attached to a catch-release actuator 22 of an existing weapon 24, in this case an AR-15 rifle. This rifle 24 includes a conventional trigger 26 extending into a trigger well 28 and protected by a trigger guard 30.

The lever assembly 20 has an L-shaped body 32 and clamp member 34 attached to the body 32 by two fasteners 36. A set screw 38 fixedly attaches the assembly 20 to the catch-release actuator 22.

The L-shaped body 32 has a first leg 40 that when attached to the weapon 24 extends downward towards the trigger 26. The first leg 40 has a clamp head 42 at a proximal end 44 and a second leg 46 extending substantially perpendicularly from a distal end 48. It is the second leg 46 that extends through the trigger well 28 to the right side of the weapon 24. As shown in FIG. 2, the second leg 46 has an arcuate indentation 50 formed in a bottom surface 52 adjacent the free end 54. Also shown in FIGS. 1 and 2 is the magazine 56 attached to the weapon 24.

Figure 3:
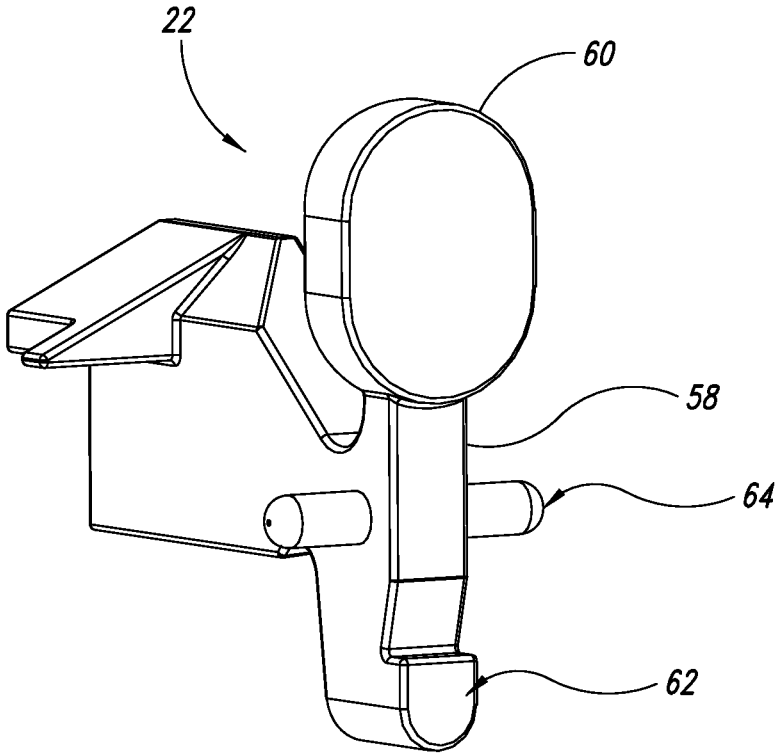
FIG. 3 is an isometric view of the catch-release actuator of the firearm of FIG. 1.
Figure 4:
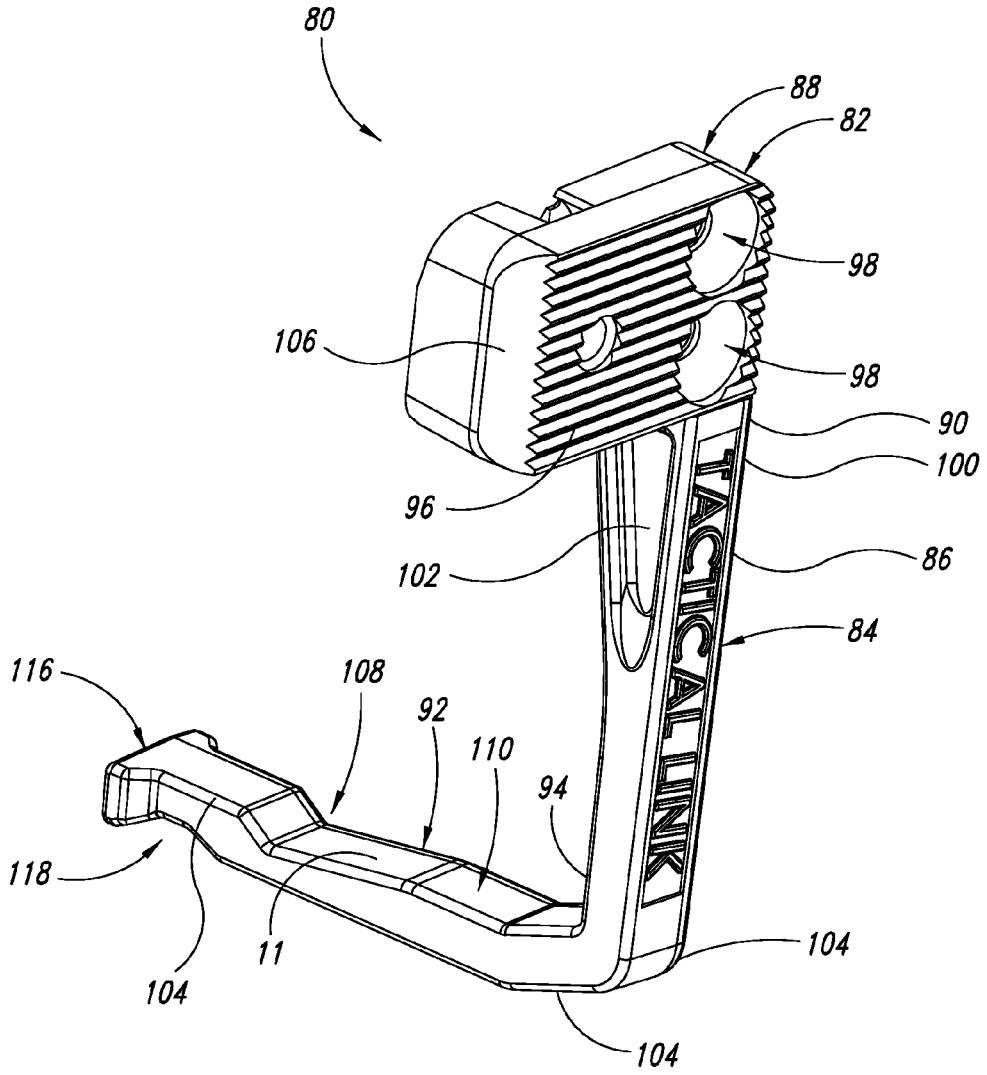
FIG. 4 is a left side front isometric view of the assembled catch-release lever assembly formed in accordance with another embodiment of the present disclosure.
Figure 5:
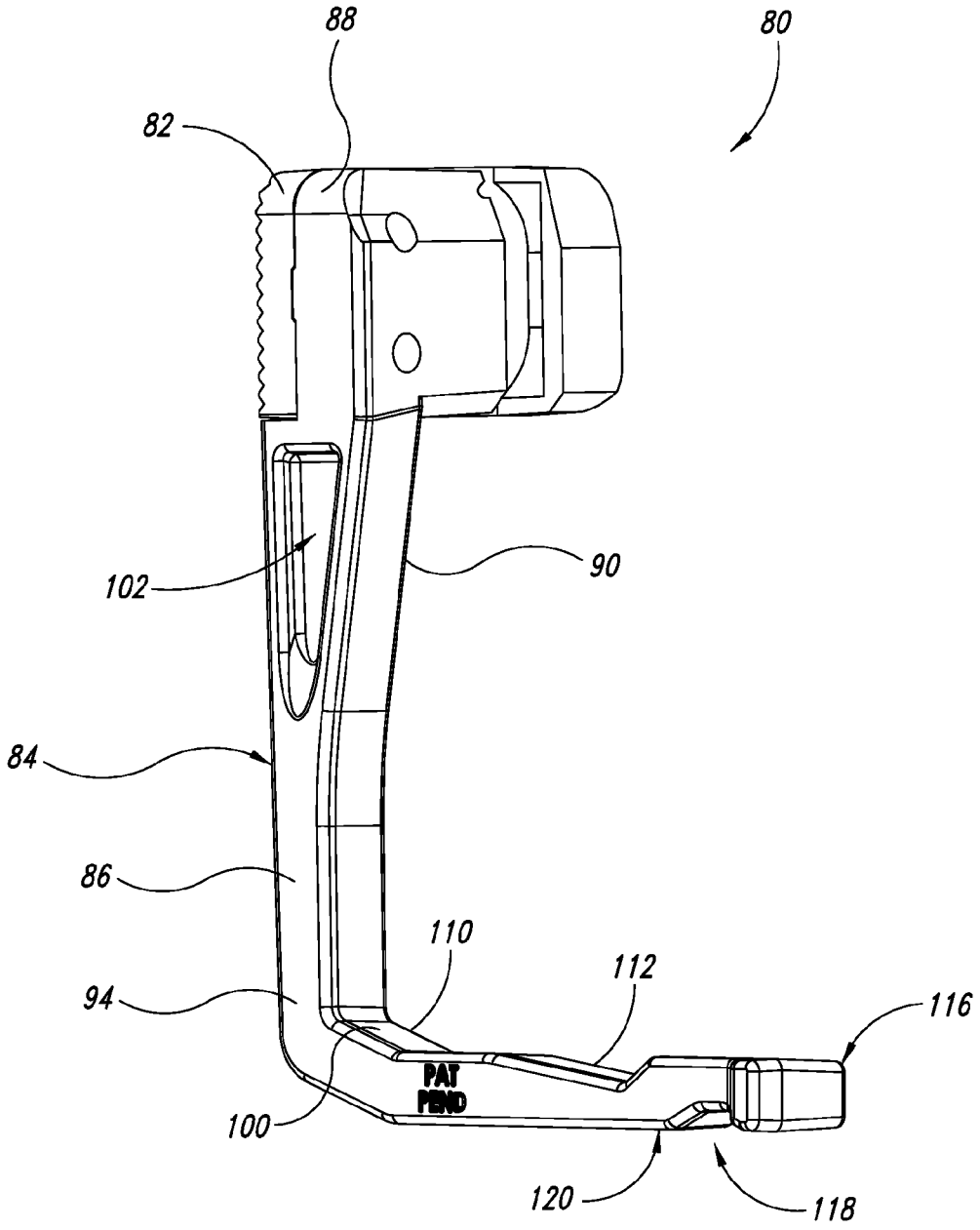
FIG. 5 is a right rear isometric view of the assembled catch-release lever of FIG. 4.
Figure 6:
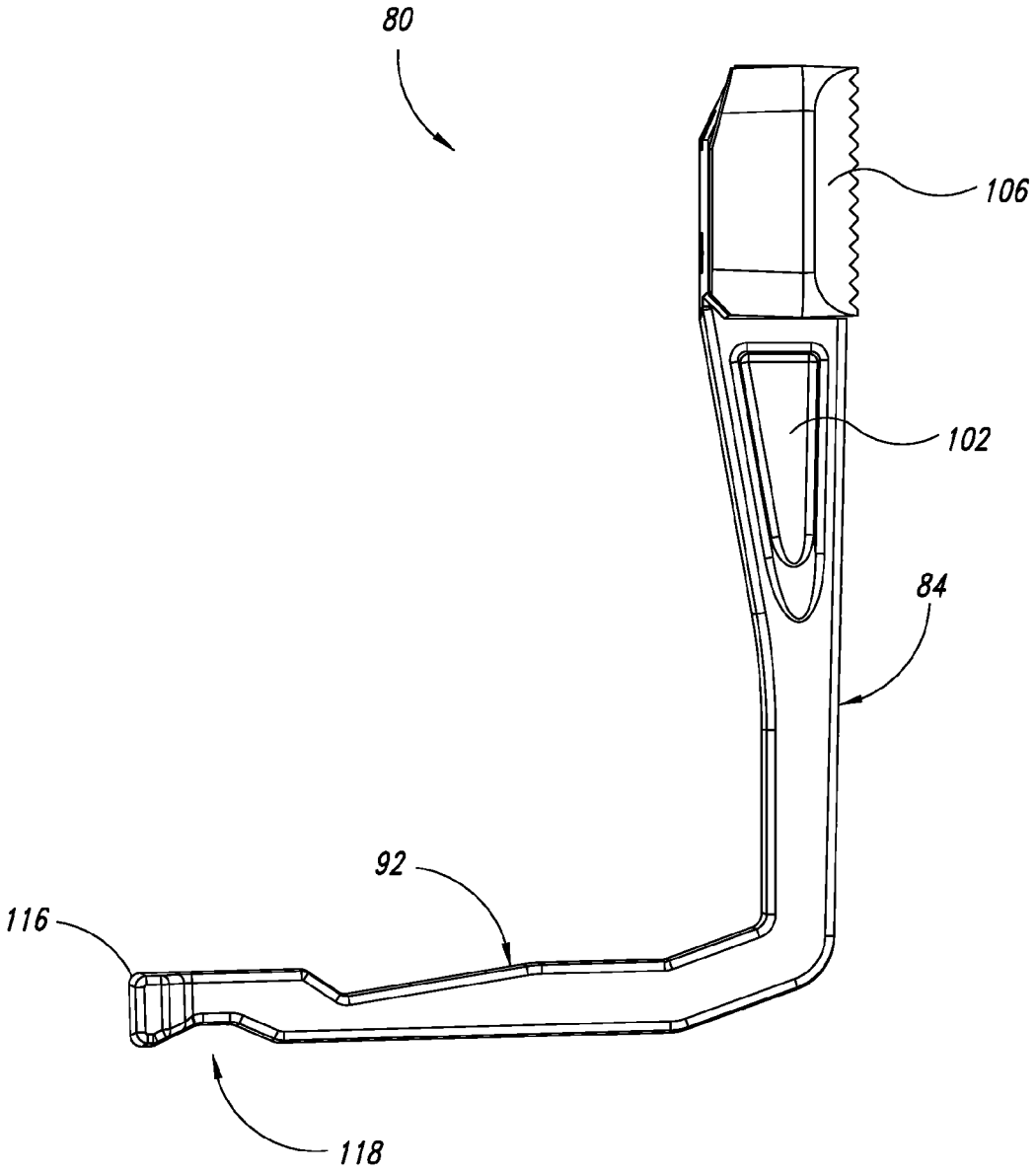
FIG. 6 is a front plan view of the assembled catch-release lever assembly of FIG. 4.
Figure 7:
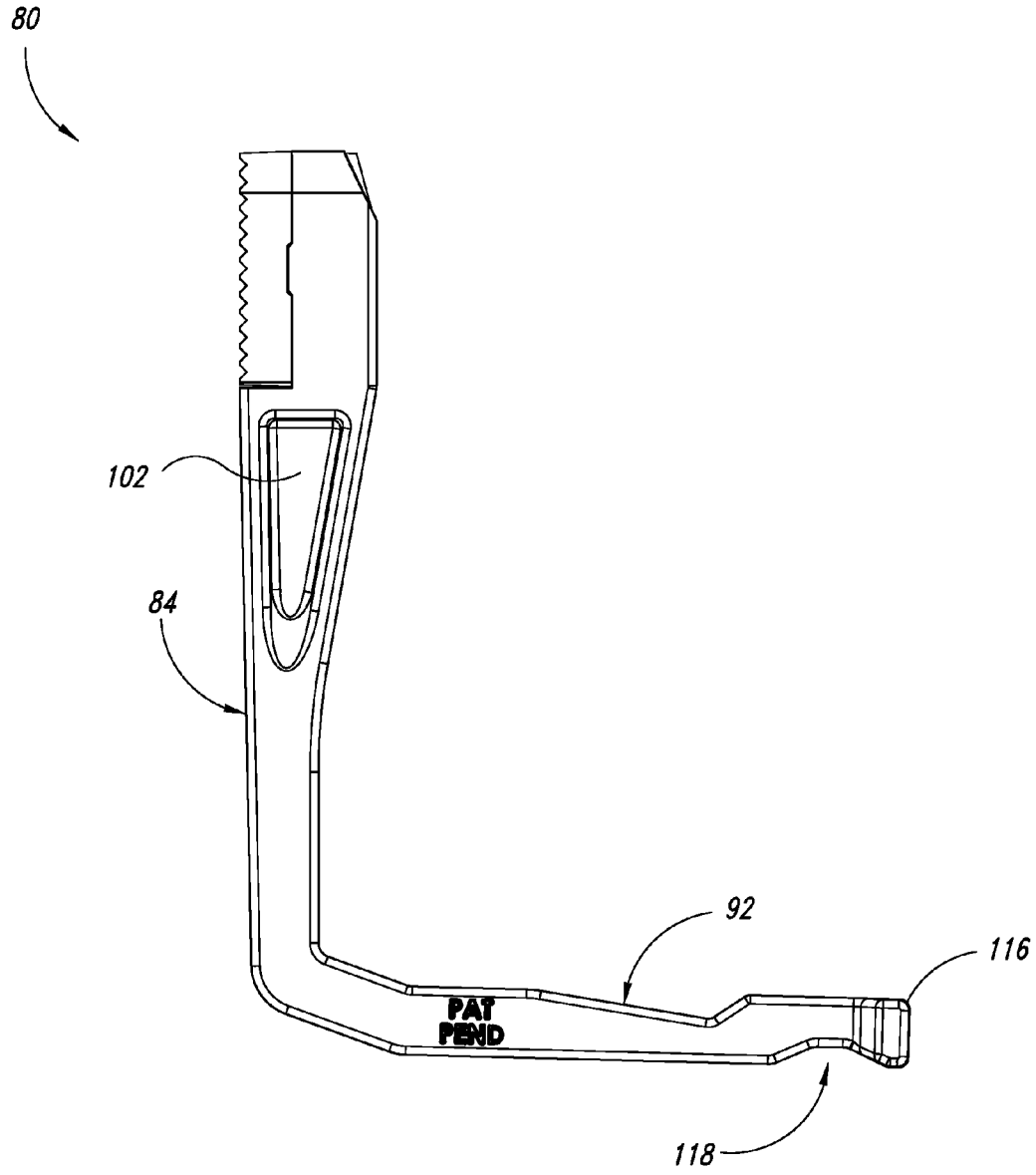
FIG. 7 is a rear plan view of the assembled catch-release lever assembly of FIG. 4.

Because the catch-release actuator 22 is hidden from view in FIGS. 1 and 2, an isometric view thereof is shown in FIG. 3. The actuator 22 includes an elongate body 58 having an oval-shaped disk or pad 60 formed at one end and a projecting button 62 formed at an opposing end. A roll pin 64 extends transversely through a midpoint of the body 58 that acts as an axis for rolling of the body 58 in a toggle-like motion when mounted to the weapon 24. The clamp member 34 cooperates with the clamp head 42 on the L-shaped lever body 40 to capture the oval-shaped disk 60.

More particularly, in this embodiment the clamp member 34 and clamp head 42 define an opening sized and shaped to be slid over the oval-shaped disk 60 of the actuator 22. The opening has a back wall or partial back wall that only allows slidable engagement with the disk 60 from the top. The set screw 38 extends through the clamp member 34 and bears against the disk 60, as will be shown and described in more detail hereinbelow in connection with FIG. 15.

Figure 15:
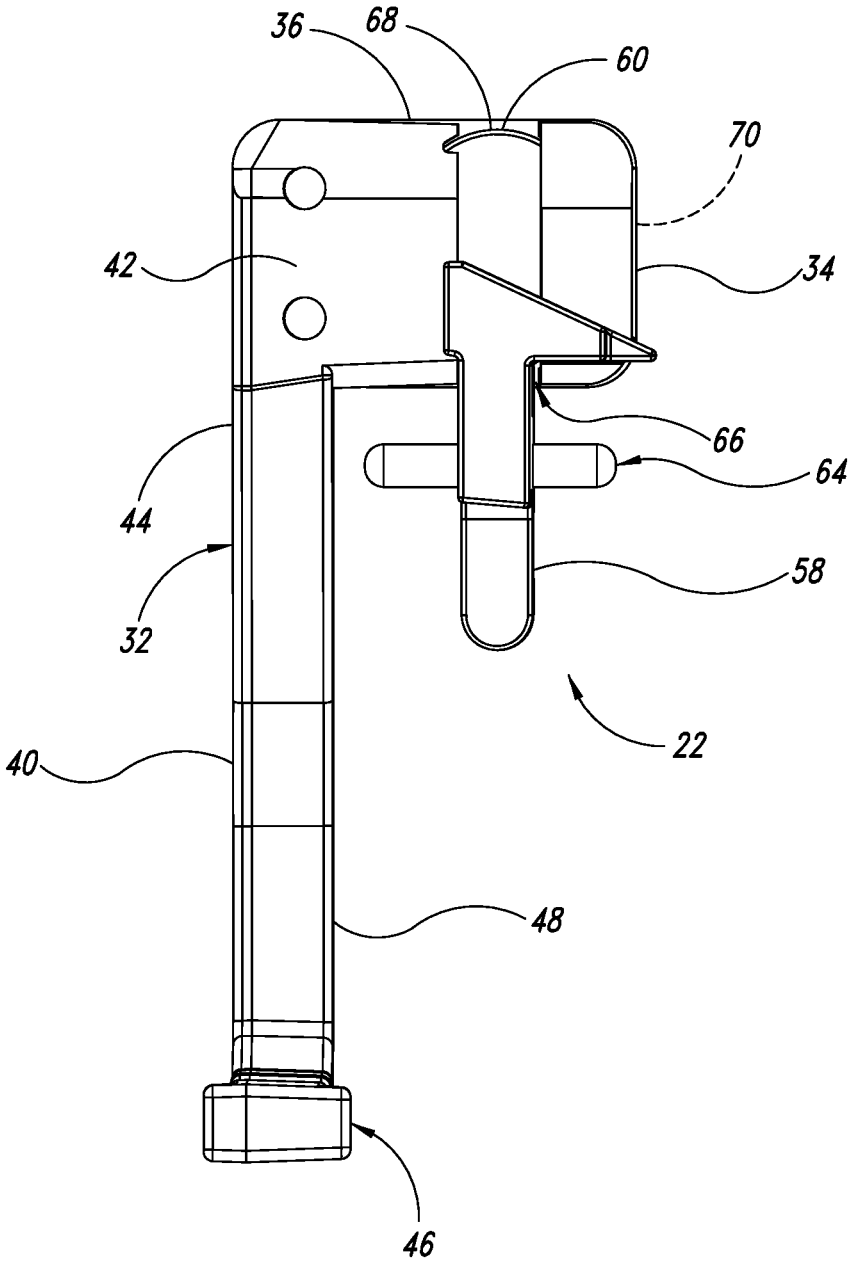
FIG. 15 is a right side plan view of the embodiment of FIG. 1 attached to the actuator shown in FIG. 3.

As can be seen in FIG. 15, the back face of the disk 60 is visible through the opening 66 created by the clamp member 34 and the clamp head 42. The opening 66 has no top, allowing the arcuate top portion 68 of the disk 60 to project slightly above the top of the clamp member 34. The inside surface 70 (shown in phantom) of each half of the opening 66 as defined by the clamp member 34 and the clamp head 42 has an arcuate top portion 72 that curves inward near the top of the opening 66 and extends downward at a straight portion 74 to a bottom of the opening 76, thus allowing the disk 60 to be slid into the opening 66 from the bottom thereof.

Figure 16:
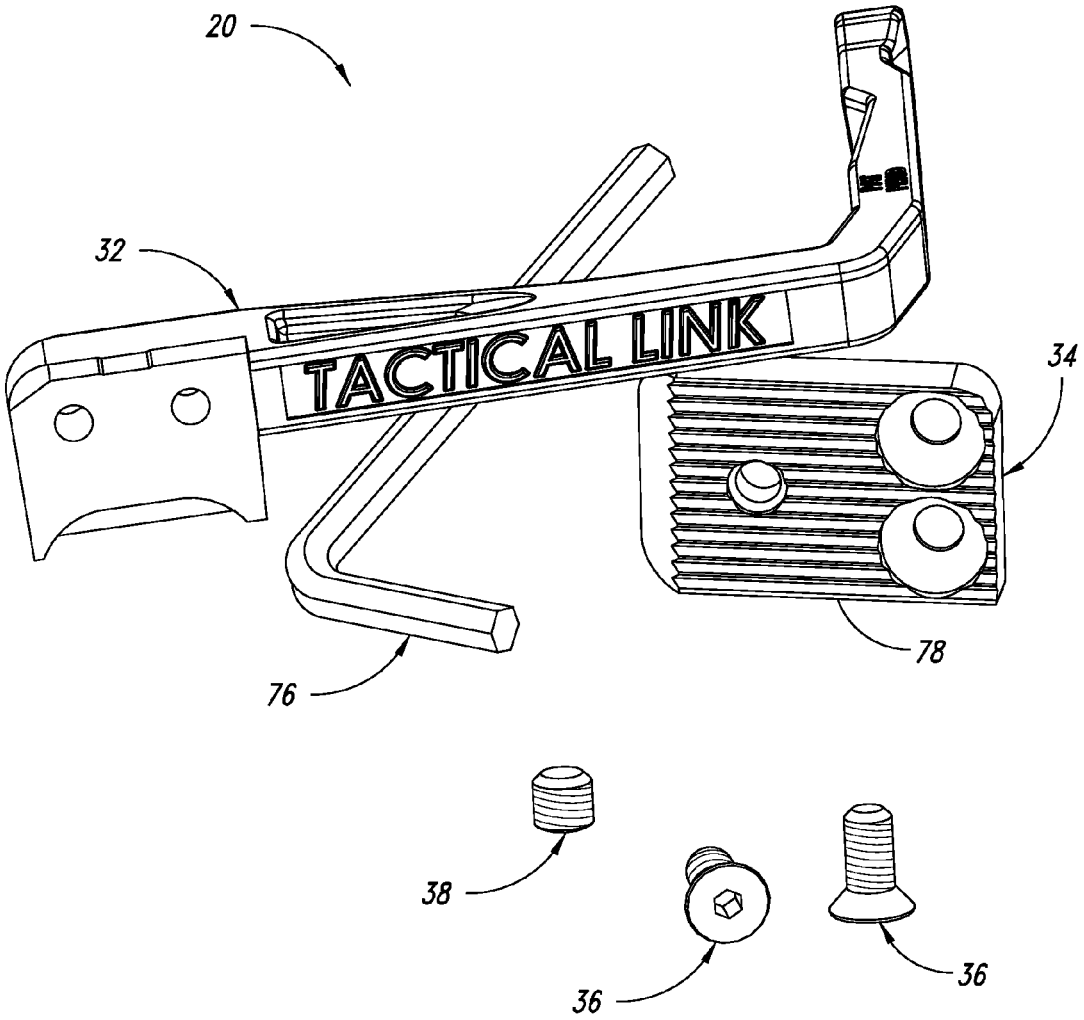
FIG. 16 is an isometric view of a kit form of the catch-release lever of FIGS. 1 and 15.
Figure 17:
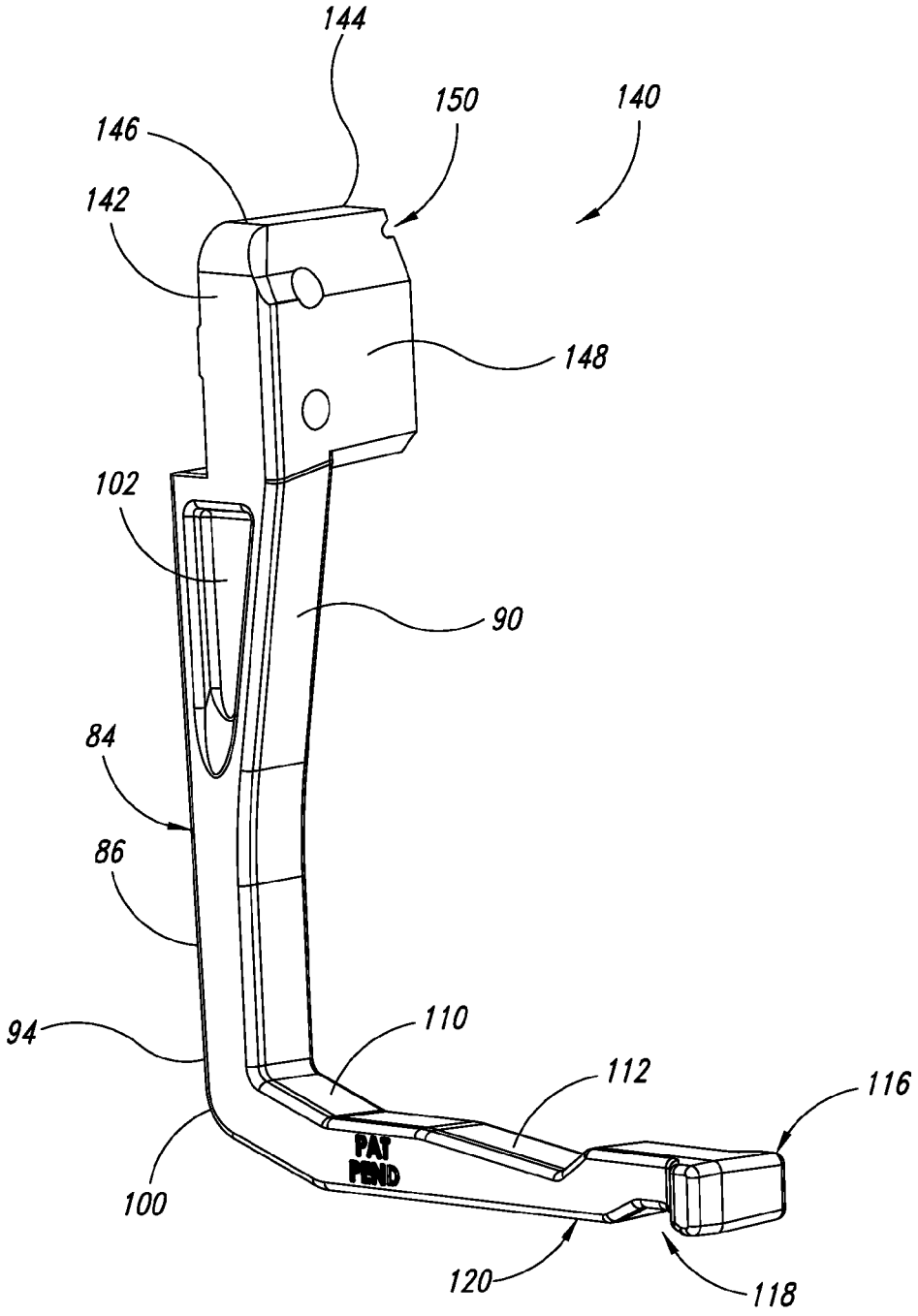
FIGS. 17-20 are right and left isometric views, left plan form, and top plan form views, respectively of an alternative configuration of an L-shaped body.
Figure 18:
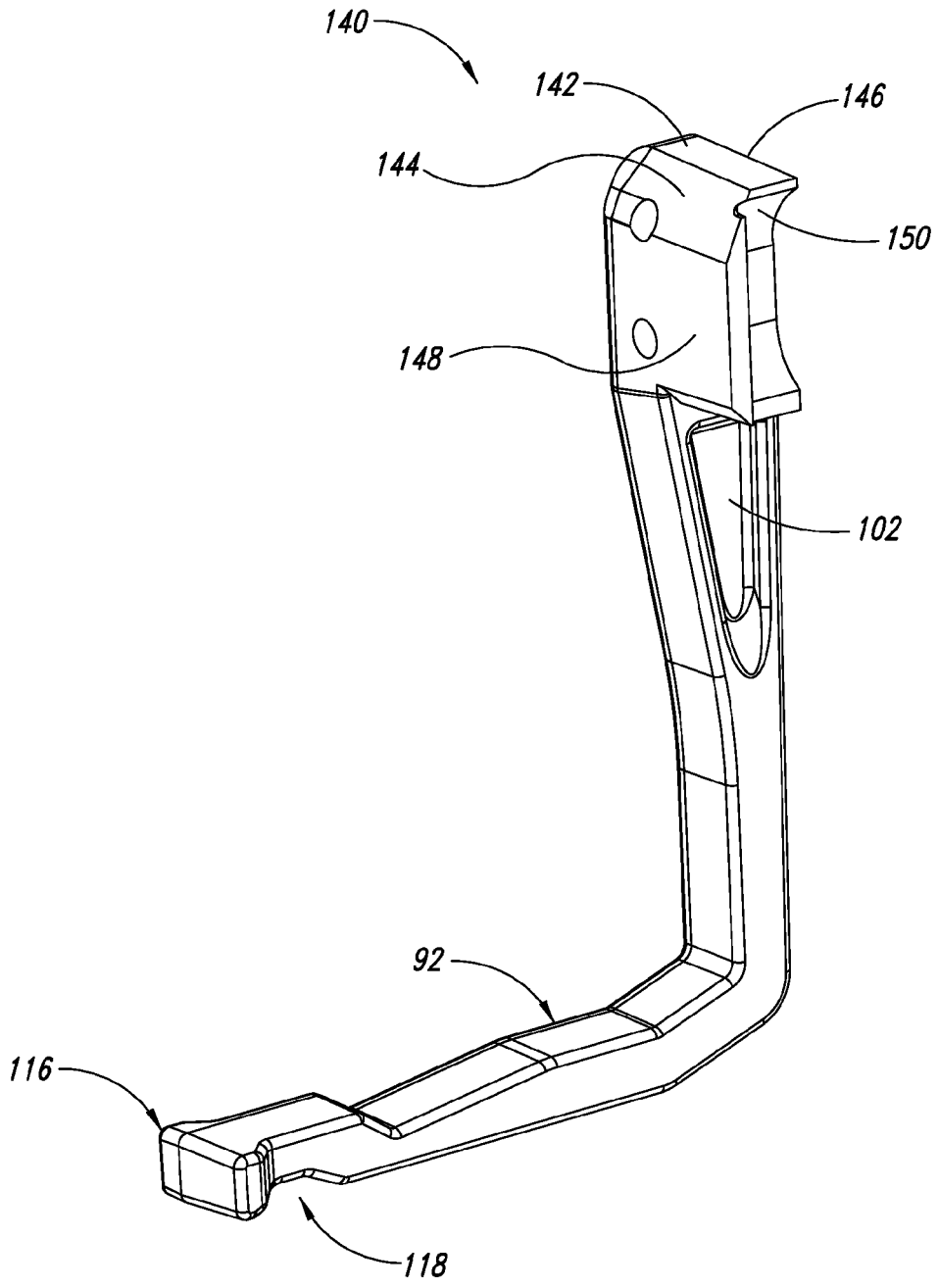
Figure 19:
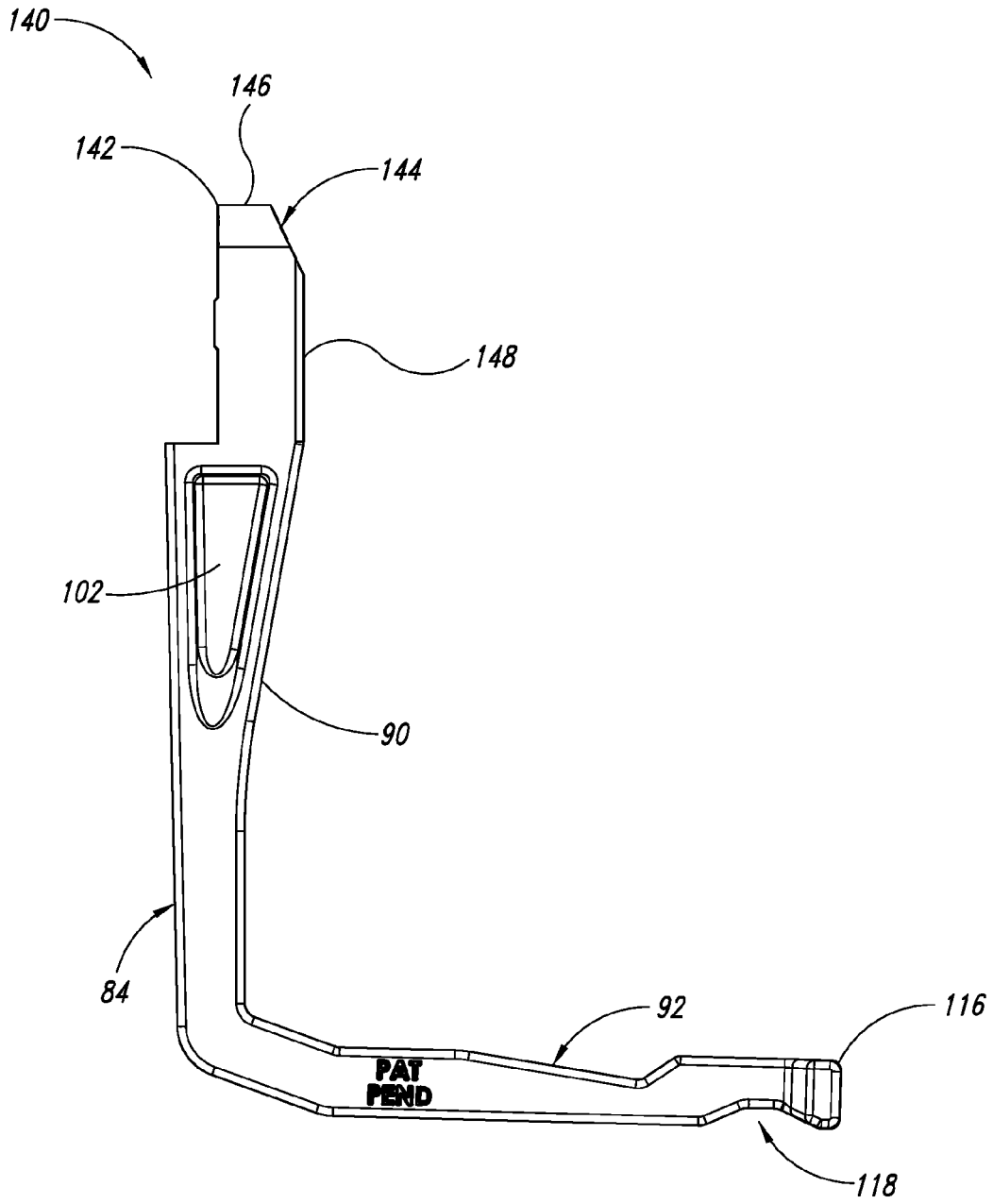
Figure 20:
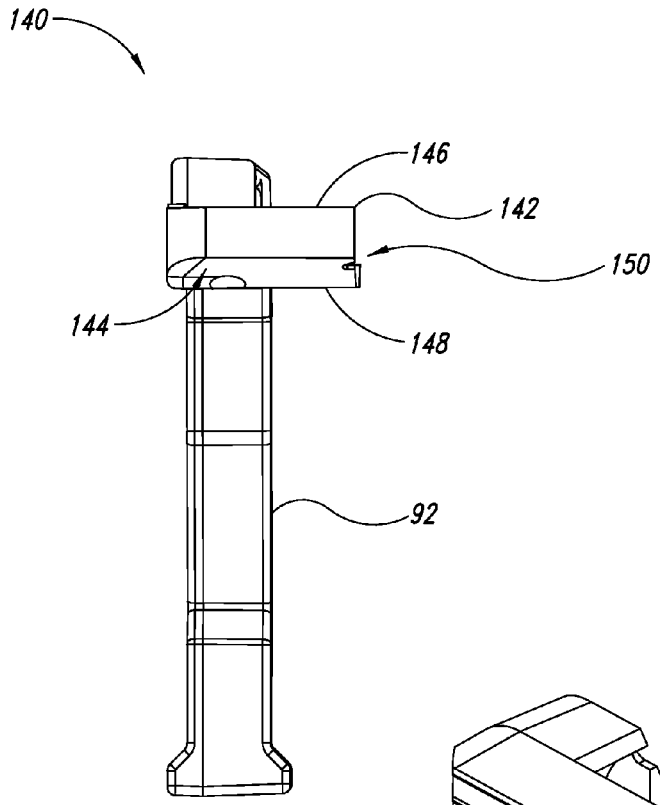
Figure 21:
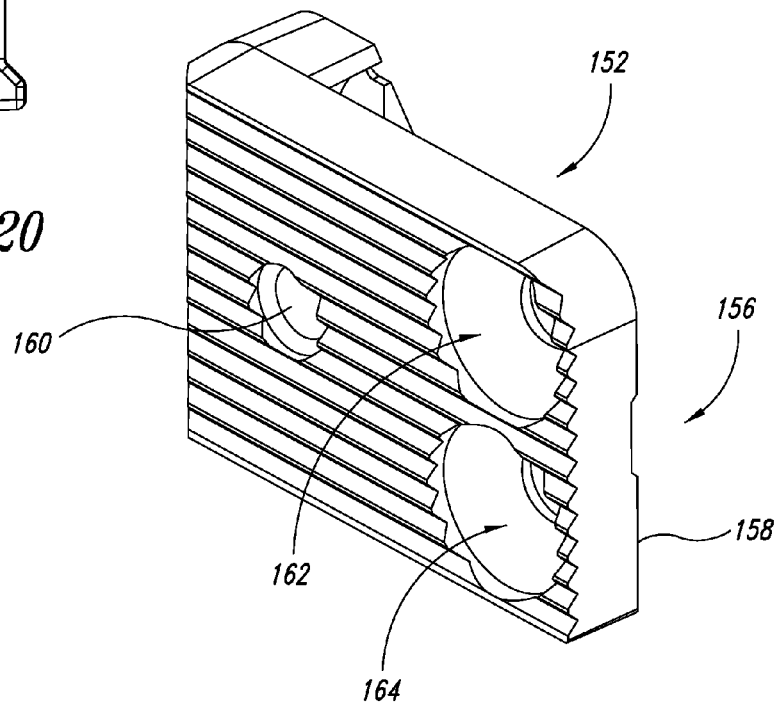
FIGS. 21-25 are a left isometric, left side plan form, front plan form, top and bottom plan form views, respectively of an alternative configuration of a clamp formed in accordance with the present disclosure.
Figure 22:
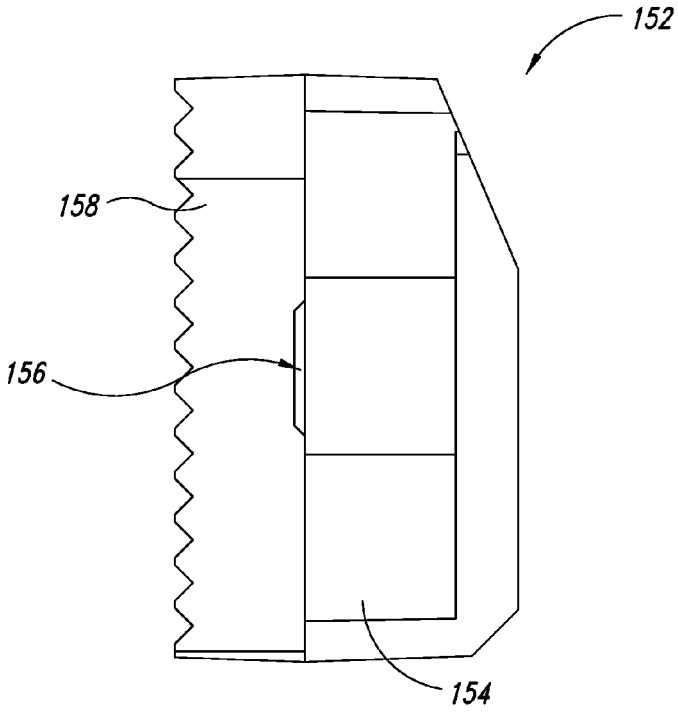
Figure 23:
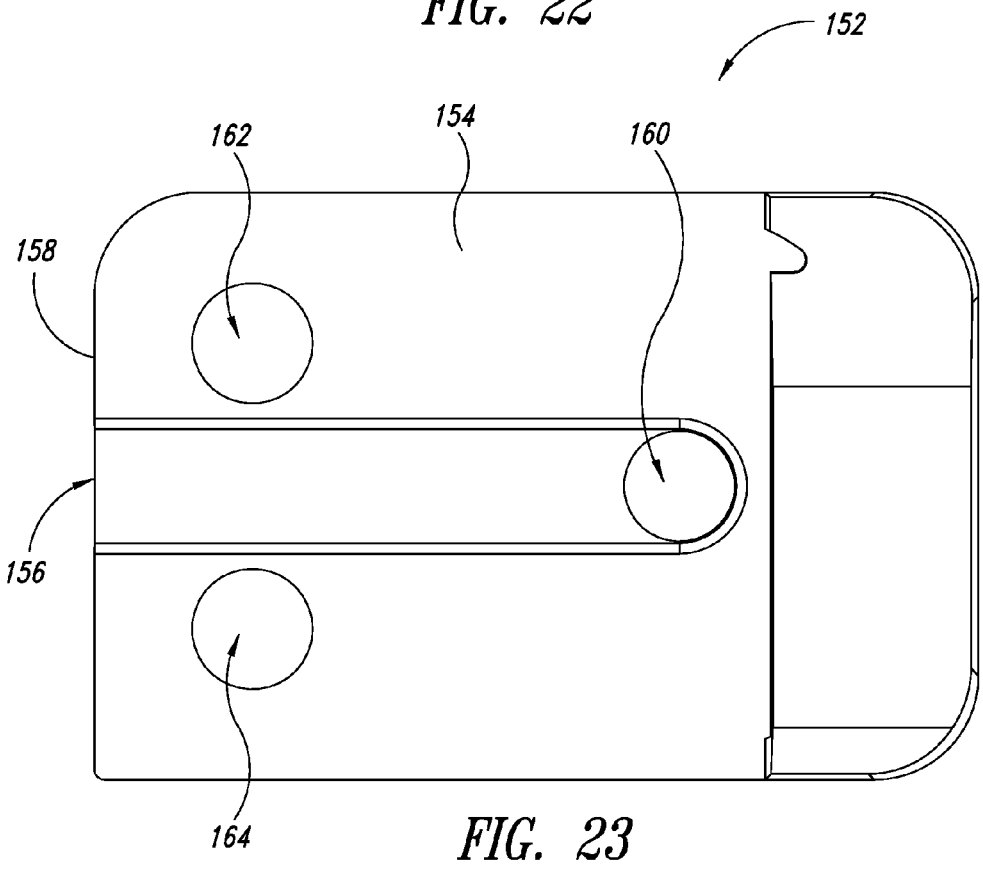
Figure 24:
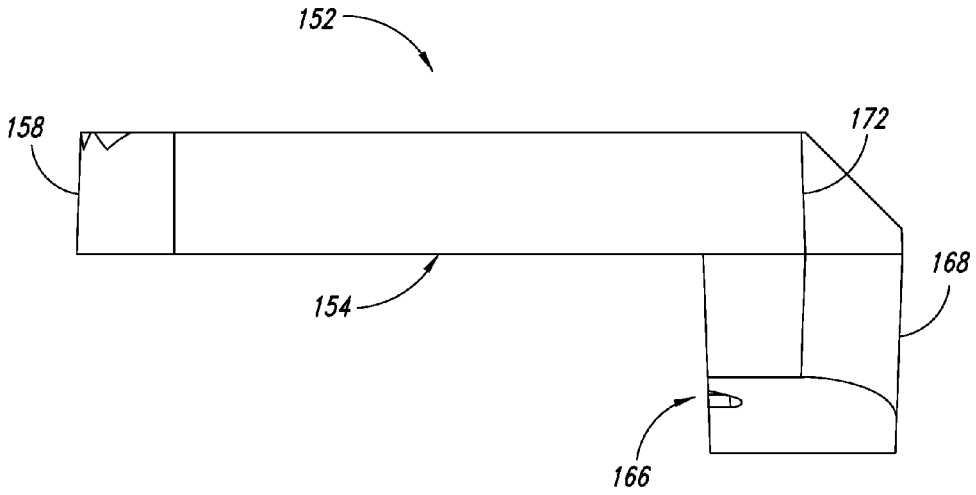
Figure 25:
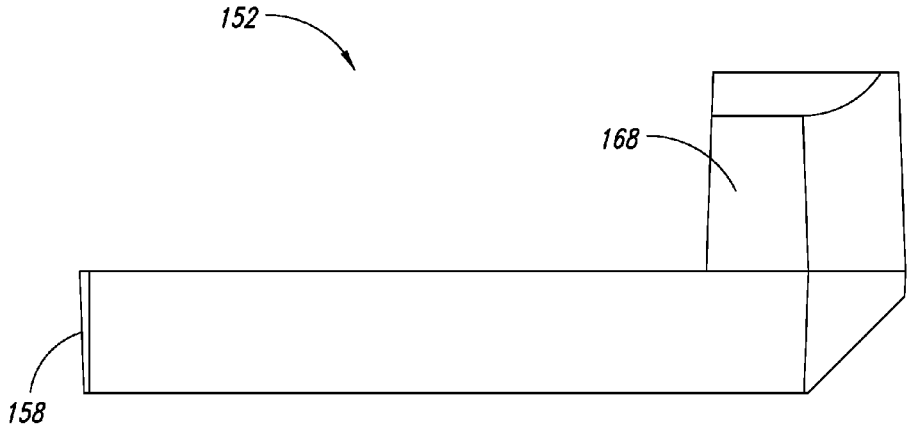

FIG. 15 shows in kit form the components of the lever assembly 20 along with a tool 76, in this case an Allen wrench that is sized and shaped to be received within matching openings in the two mounting screws 36 and set screw 38. As can be seen here, the clamp member 34 has an exterior surface 78 that is ribbed to provide a gripping surface for a user's finger or thumb to manipulate the lever assembly 20 when in operation. The kit form shown in FIG. 16 can be sold with or without the tool 76. However, preferably the tool is included to facilitate easy assembly and installation. In use, the clamp member 34 can be loosely attached to the L-shaped body 32, then slid over the actuator 22 where the mounting screws 36 and set screw 38 are then tightened by the tool 76.

In operation, the bolt catch-release actuator 22 automatically locks the bolt in the back position when the last round in the magazine 56 is fired. However, if it is desirable to manually pull the bolt back and lock it in position, the lever assembly 20 can be manipulated by the user's left or right thumb on the exterior 78 of the clamp member 34 by pushing it in towards the weapon 24. The user can simply lift up on the lever using their trigger finger while pulling back the charging lever with their support hand (without having to switch hands) and the bolt will be locked open. After a jam has been cleared or maintenance completed, or after a magazine has been replaced in the weapon 24, the user can quickly and easily release the catch-release mechanism by using their trigger finger and pushing upward in the indentation 50 at the free end 54 of the second leg 46. This facilitates the user being more quickly in a ready-to-fire configuration with their right hand and trigger finger.

FIGS. 4-14 illustrate another embodiment of the present disclosure in which a catch-release lever assembly 80 is shown to include a clamp member 82 attached to an L-shaped body 84. The body 84 includes a first leg 86 having a clamp head 88 formed at a proximal end 90 and a second leg 92 extending at substantially a right angle from a distal end 94. The clamp member 82 includes a ribbed exterior surface 96 and two countersunk openings 98 to receive the mounting screws and a non-countersunk opening 100 for the set screw.

Other features visible in this embodiment of the present disclosure include a scallop 102 formed on one or both sides of the first leg 86 and various faces or facets 104 formed on the corners and sides of the L-shaped body 84 that have no purpose other than ornamentation. The clamp member 82 has an angled face 106 to provide clearance with other components on the weapon 24.

The second leg 42 has a step 108 formed in the top surface 110 of the second leg 92 for clearance with the trigger guard 30 on the weapon 24. The step 108 is formed by a first angled surface 112 that angles downward and away from the distal end 94 of the first leg 86 and a second angled surface 114 that angles upward from the first angled surface 112 towards the free end 116. In addition, a notch 118 is formed in a bottom surface 120 of the second leg 92 adjacent the free end 116.

Figure 8:
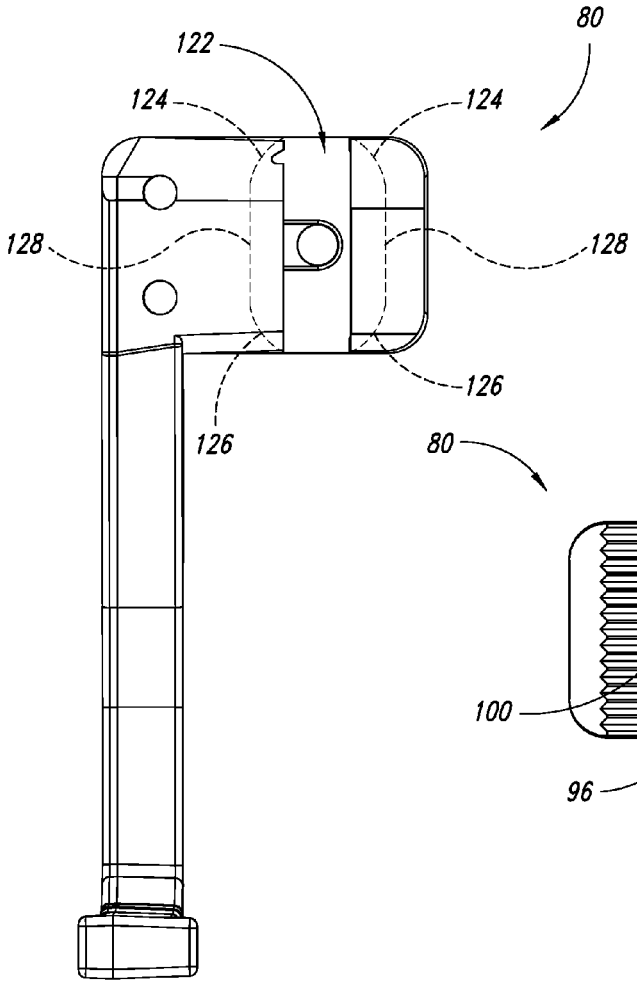
FIG. 8 is a right side plan view of the assembled catch-release lever assembly of FIG. 4.
Figure 9:
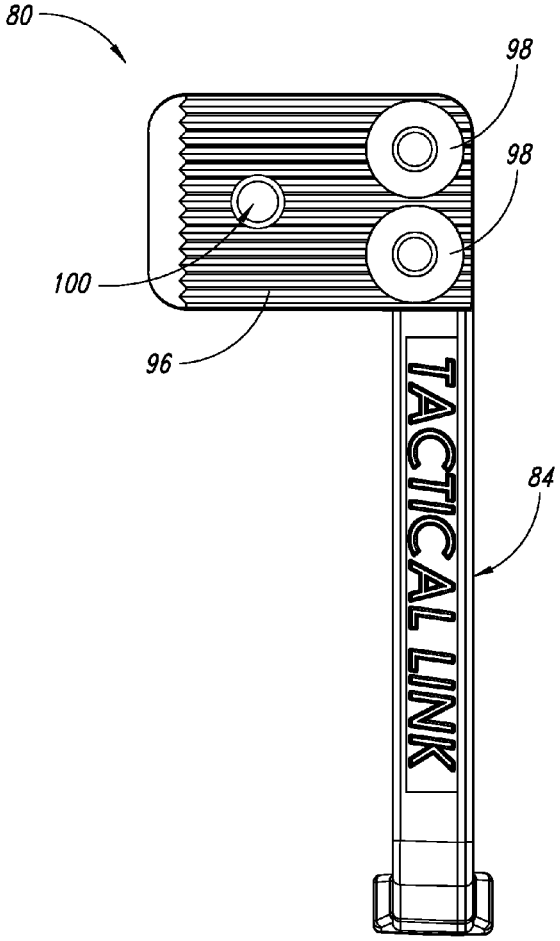
FIG. 9 is a left side plan view of the assembled catch-release lever assembly of FIG. 4.
Figure 10:
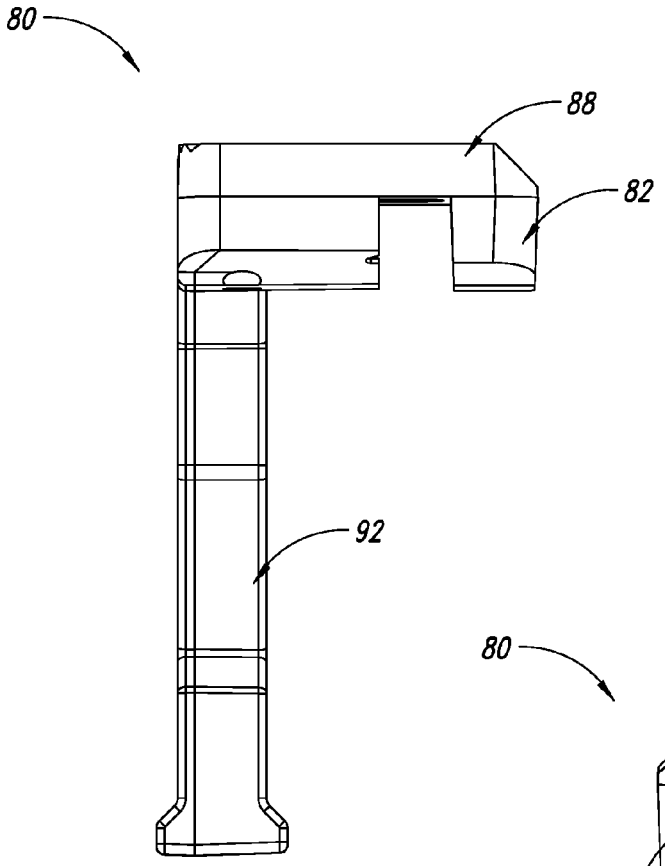
FIG. 10 is a top plan view of the assembled catch-release lever assembly of FIG. 4.
Figure 11:
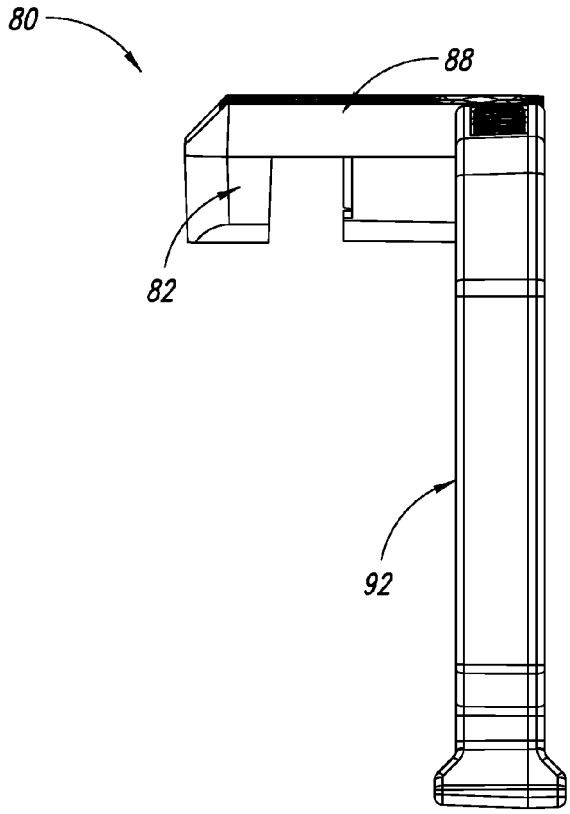
FIG. 11 is a bottom plan view of the assembled catch-release lever of FIG. 4.
Figure 12:
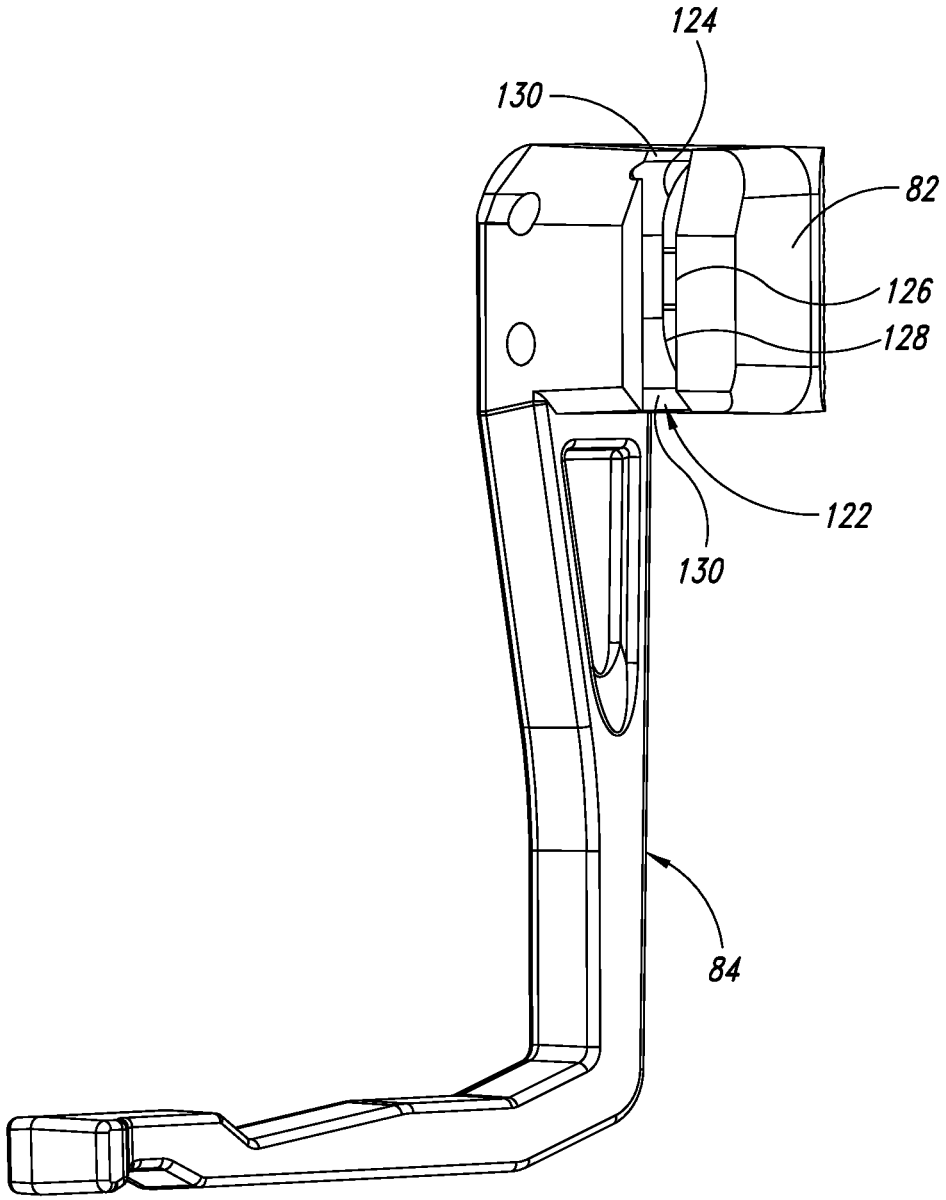
FIG. 12 is a right front isometric view of the assembled catch-release lever of FIG. 4.
Figure 13:
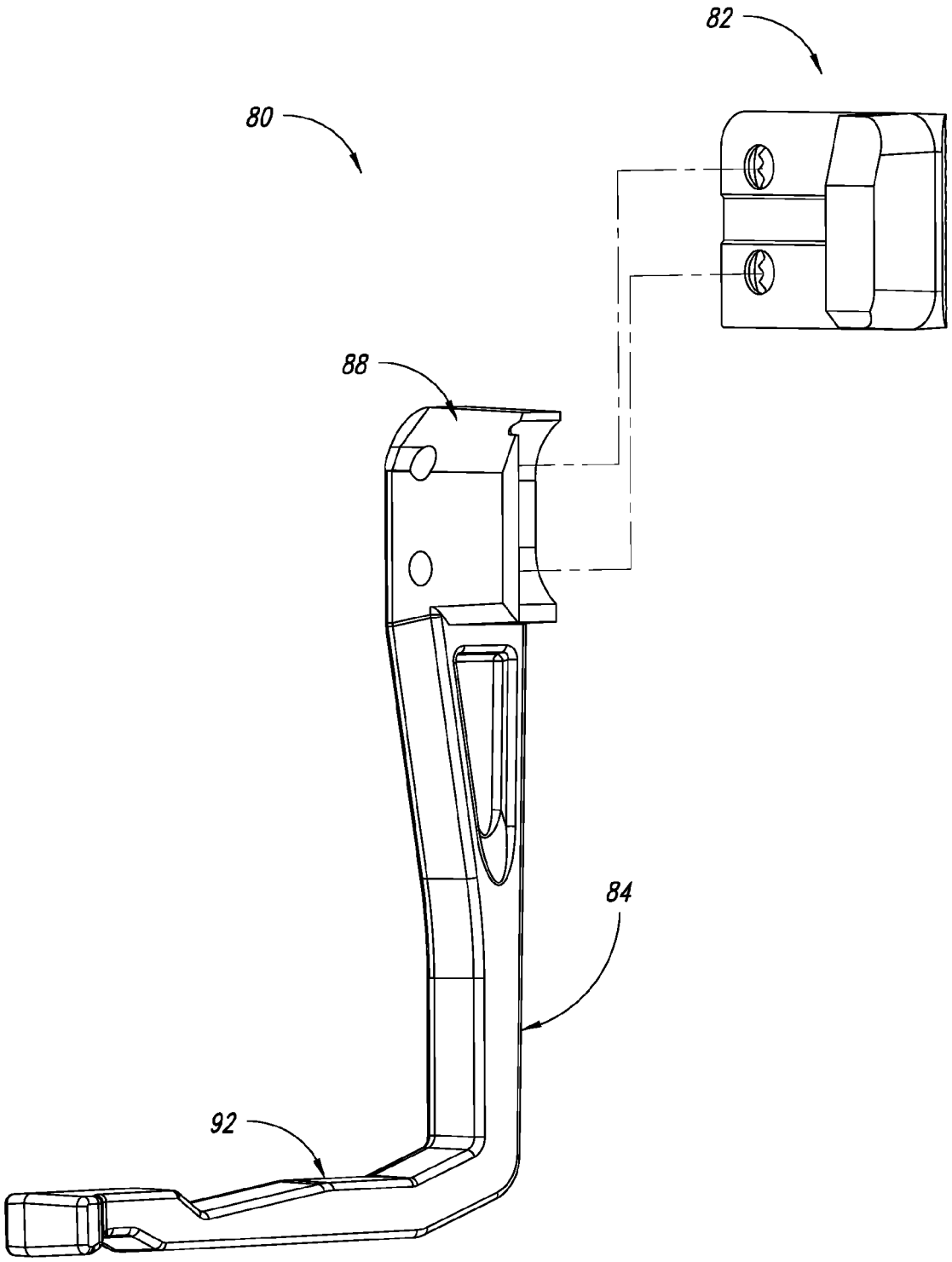
FIG. 13 is an exploded isometric view of the catch-release lever assembly of FIG. 12 formed in accordance with the embodiment of FIG. 4.
Figure 14:
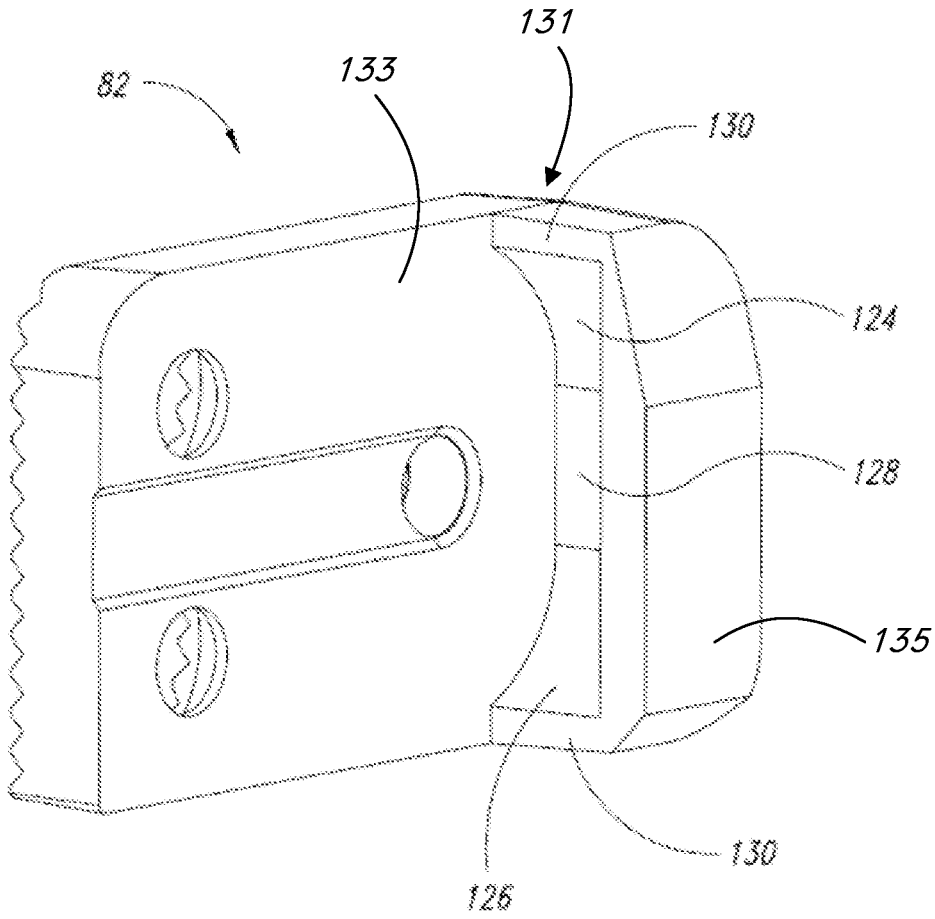
FIG. 14 is an isometric view of a clamp member formed in accordance with the embodiment of FIG. 4.

As shown more clearly in FIGS. 8 and 12-14, in this embodiment the opening 122 formed by the clamp member 82 and the clamp head 88 has arcuate top and bottom portions 124, 126, respectively, as shown by the phantom lines in FIG. 8. As shown in FIG. 14, the clamp member 82 has a stepped wall 131, comprising a front wall 133 and a back wall 135, with straight portion 130 separating the front wall 133 from the back wall 135. A straight center section 128 connects the arcuate top and bottom sections 124, 126. Straight portions 130 can be seen more clearly in FIGS. 12-14 that transition from the arcuate top and bottom portions 124, 126 to the top and bottom exterior surfaces of the clamp member 82 and clamp head 88. With this configuration, the lever assembly 80 must be assembled around the actuator 22 instead of being slipped over the top as with the previous embodiment because the arcuate bottom portions 126 close off the opening 122. While this involves slightly more manipulation of the clamp member 82 and clamp head 88 to attach it to the actuator 22, it provides much more stability to the attached assembly 80, effectively preventing any inadvertent removal or detachment of the lever assembly from the actuator 22 that could result from repeated vibration and shock while the weapon 24 is being fired.

FIGS. 17-20 illustrate an alternative configuration of an L-shaped paddle body 140 in which similar components with the previous embodiment bear the same reference numbers for ease of illustration. In this configuration, the clamp head 142 has a beveled face 144 adjacent the top 146 and angling downward to intersect a front face 148 to provide additional clearance between the paddle body 140 and the receiver of the weapon. In some weapons additional clearance is needed due to the size and shape thereof. Ideally the beveled face 144 is at about a 45 degree angle with respect to the top 146 and the front face 148 of the clamp head 142. Alternatively it can be in the range of 30 degrees to 60 degrees with respect to the front face 148. A notch 150 is formed in the beveled face 148 that is in the shape of a half circle that opens towards the outside of the head 142.

FIGS. 21-25 illustrate an alternative configuration of the clamp 152 in which a back surface 154 includes a transverse channel 156 centrally located thereon and extending from a first side wall 158 to a first central opening 160 in the clamp 152. The channel 160 is as wide as the opening 160 and extends between second and third openings 162, 164 formed in the clamp 152. A half circular notch 166 is formed in a projection 168 that extends from a second side wall 172 of the clamp 152.

In all other respects, the embodiments described above are used in the same manner. Preferably the components are formed from metal, although high-strength composite light-weight material may be used to save weight.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. For example, the present disclosure can be modified for use with left-handed users, as will be evident to one of skill in this technology. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A mechanism for use with an object, comprising:

a lever assembly comprising a first extension leg and a second extension leg projecting at an angle to the first extension leg, the first extension leg having a first clamp member formed on one end, the second extension leg having a finger engaging groove formed on a surface adjacent one end thereof, the lever assembly further comprising a second clamp member structured to be attached to the first clamp member to form a two-part clamp, and further comprising a ledge formed on one of the first and second clamp members that cooperates with a second ledge on the other of the first and second clamp members to form a receptacle, and further comprising a set screw threadably engaged with one of the first and second clamp members to project into the receptacle formed by the first and second clamp members to bear against the object when the mechanism is attached to the object, the first clamp member having a stepped wall defining a longitudinally oriented shoulder, the stepped wall having a back wall and a front wall, the back wall having a length that is shorter than a length of the front wall so that when the second clamp member is attached to the first clamp member, an opening is left between a free edge of the back wall and the ledge of the first clamp member that opens into the receptacle, and the first and second clamp members are configured to define an opening having a closed front, an open top and open bottom, and two sidewalls, each sidewall having an arcuate top portion and arcuate bottom portion.

2. The mechanism of claim 1 wherein the second clamp member comprises a front wall, a side wall extending from a side of the front wall, and a back wall extending from the sidewall and spaced in parallel relationship to the front wall to form a channel between the front wall and the back wall.

3. The mechanism of claim 1, further comprising a straight portion connecting the arcuate top and bottom portions.

4. The mechanism of claim 1, comprising top and bottom straight sections at free ends of the top and bottom arcuate portions.

5. A mechanism for use with an object, comprising:

a lever assembly comprising a first extension leg and a second extension leg projecting at an angle to the first extension leg, the first extension leg having a first clamp member formed on one end, the second extension leg having a finger engaging groove formed on a surface adjacent one end thereof, the lever assembly further comprising a second clamp member structured to be attached to the first clamp member to form a two-part clamp, and further comprising a ledge formed on one of the first and second clamp members that cooperates with a second ledge on the other of the first and second clamp members to form a receptacle, and further comprising a set screw threadably engaged with one of the first and second clamp members to project into the receptacle formed by the first and second clamp members to bear against the object when the mechanism is attached to the object; and wherein the first and second clamp members define an opening having a closed front, an open top and open bottom, and two sidewalls, each sidewall having an arcuate top portion and arcuate bottom portion.

6. The mechanism of claim 5, further comprising a straight portion connecting the arcuate top and bottom portions.

7. The mechanism of claim 5, comprising top and bottom straight sections at free ends of the top and bottom arcuate portions.

8. An assembly for a bolt catch on a firearm having a bolt that slides between a latched position and an unlatched position, the bolt held in the latched position by a bolt catch mechanism that includes a catch-release actuator pivotally mounted on the rifle to provide for latching and unlatching of the bolt by a user, the assembly comprising:

a lever having an L-shaped body that comprises a first leg and a second leg that is formed at substantially a right angle to the first leg, the first leg having a free end on which is formed a mounting member;

a clamp member structured to attach to the mounting member on the lever, the clamp member and mounting member cooperating to enable clamping of the lever to the catch-release actuator in slidable engagement therewith with the mounting member being positioned between the catch-release actuator and the firearm and the clamp member being positioned on the outside of the catch-release actuator, the mounting member and clamp member configured to define an opening having a closed front, an open top and open bottom, and two sidewalls, each sidewall having an arcuate top portion and arcuate bottom portion.

9. The assembly of claim 8, further comprising a straight portion connecting the arcuate top and bottom portions.

10. The assembly of claim 8, comprising top and bottom straight sections at free ends of the top and bottom arcuate portions.

* * * * *